US006692233B2

(12) United States Patent
Liang

(10) Patent No.: US 6,692,233 B2
(45) Date of Patent: Feb. 17, 2004

(54) LOCKABLE QUICK-RELEASE BLADE ASSEMBLY FOR CEILING FANS

(75) Inventor: Hai Liang, Zhongshan (CN)

(73) Assignee: Hoo Cheung Group Ltd., Kowloon (HK)

( * ) Notice: Subject to any disclaimer, the term of this patent is extended or adjusted under 35 U.S.C. 154(b) by 10 days.

(21) Appl. No.: 10/184,701

(22) Filed: Jun. 26, 2002

(65) Prior Publication Data

US 2004/0001758 A1 Jan. 1, 2004

(51) Int. Cl.[7] ..... F04D 29/34

(52) U.S. Cl. ..... 416/221; 416/206; 416/220 A; 403/325; 403/327; 403/328

(58) Field of Search ..... 416/5, 204 R, 416/206, 207, 208, 210 R, 214 R, 220 A, 221; 403/325, 327, 328

(56) References Cited

U.S. PATENT DOCUMENTS 4,725,027 A * 2/1988 Bekanich ..... 248/125.8
5,239,884 A * 8/1993 Norsen ..... 74/551.8
5,372,480 A * 12/1994 Van Meter et al. ..... 416/214 R
5,980,353 A * 11/1999 Wu ..... 416/210 R
6,010,306 A 1/2000 Bucher et al.
6,027,310 A * 2/2000 Kerr, Jr. et al. ..... 416/210 R
6,059,531 A 5/2000 Tai
6,220,778 B1 * 4/2001 Suchanek et al. ..... 403/327
6,378,824 B1 * 4/2002 Tseng ..... 248/220.21
6,390,777 B1 5/2002 Kerr, Jr.
2002/0054816 A1 5/2002 Bucher et al.

* cited by examiner

*Primary Examiner*—Christopher Verdier
(74) *Attorney, Agent, or Firm*—Frommer Lawrence & Haug LLP; Ronald R. Santucci

(57) ABSTRACT

A lockable quick-release blade assembly for ceiling fans is disclosed. The lockable blade assembly comprises a fan blade having one end for inserting into a blade receiving slot in a fan rotor. The blade inserting end is provided with a notch on the longitudinal side for lockably engaging with a blade locking member. A housing defining the blade receiving slot and comprises a blade locking member and a blade releasing member. The blade locking member has a spring biased locking bolt for locking into the notch of the inserted fan blade. The blade releasing member has a spring biased slide slice located atop the housing and abutting the spring biased locking bolt at a 45° angle so that upon a user pressing the releasing member the locked fan blade is released from the locking member.

9 Claims, 5 Drawing Sheets

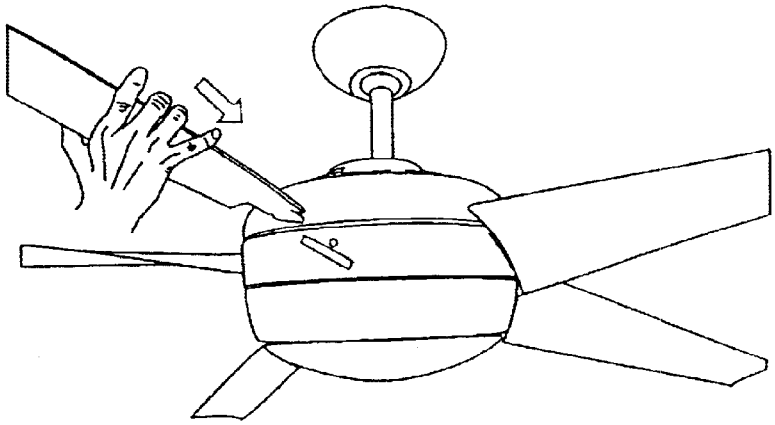
FIG. 1
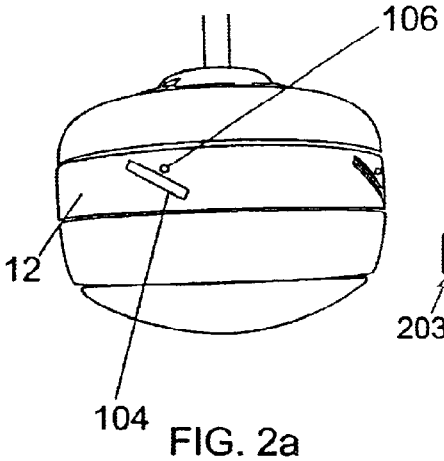
FIG. 2a
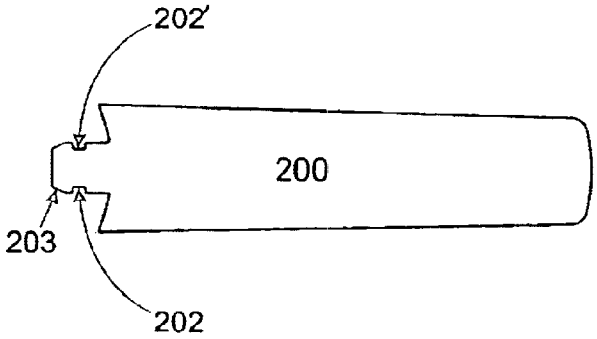
FIG. 2b
FIG. 2c

LOCKABLE QUICK-RELEASE BLADE ASSEMBLY FOR CEILING FANS

FIELD OF THE INVENTION

This invention relates to a lockable quick-release blade assembly for ceiling fans. The blade assembly enables a user to insert or remove blades from the ceiling fan rotor easily and quickly.

BACKGROUND OF THE INVENTION

Ceiling fans are very common household and commercial appliances. Traditional ceiling fans are difficult to install and equally troublesome to dust off the fan blades. Installation of a conventional ceiling fan usually means the installer standing on a stool or scaffold trying to work overhead with the mechanical and electrical attachments of the motor housing and rotor components of the fan. After the motor housing and rotor are properly positioned, the installer must then attach the fan blades to the fan rotor. This typically means trying to work from the underside of the fan and to fasten the blades and/or blade mounting arms to the motor or rotor by screws with precision. Depending on the number of blades, the same procedure has to be repeated many times before installation is completed. Such traditional fastening method is highly unsatisfactory. It requires the installer great dexterity, patience, efforts and time in order to connect each and every blade to the fan rotor. In most cases the blades are fastened by screws which may become loose over time due to vibration during operation.

Screw fastened ceiling fan blades also make cleaning and dusting very difficult. It will take too much efforts to unfasten the blades and remove them from the rotor for thorough cleaning. As a result, most of the time the only practical way to clean the blades is by sweeping the fan blades with a duster. This is highly undesirable as the dust will likely fall down the space below and further dirtying the surrounding furniture and the cleaner.

In view of the foregoing shortcomings, it is advantageous to have a ceiling fan whereby the blades can be easily attached to the rotor without the aid of special tools. Likewise, it is desirable to dislodge the blades from the rotor without having to exert excessive efforts. Attempts have been made to achieve this objective in the prior art. For example, U.S. Pat. No. 6,010,306 (Bucher et al.) and U.S. Pat. No. 2002/0054816 (Bucher et al.) endeavour to attach ceiling fan blades to the rotor mounting arms by coupling or biasing means, thus avoiding the need to use screws. However, the Bucher et al. design still require the user to fasten the rotor mounting arms to the rotor by traditional screws. Accordingly, it is beneficial to develop a quick-release blade assembly such that the blades can be attached to the rotor directly without having to first attach to a mounting plate and therefore avoiding the use of any tools or screws.

In U.S. Pat. No. 6,390,777 (Kerr, Jr.), it discloses a quick-connect fan blade mounting assembly in which the blade holders are inserted into the rotor housing. The blade mounting holders are subsequently secured in place by rotating a ring cover in the mounting assembly. However, the Kerr, Jr. system does not do away with the need to first attach the fan blades with the blade holders.

A direct blade-to-rotor design was described in U.S. Pat No. 6,059,531 (Tai). Tai describes an impeller and fan blade attachment assembly which enables the fan blades to be inserted directly into the rotor housing. The blades are secured in place by a coil spring-acutated plate attached inside the rotor housing and abutting the opening for the blades. When in the inserted position, the coil spring-acutated plate biases against a corresponding aperture located in the blades. However, the Tai design does not afford very secure positioning of the inserted blade. When the fan is in operation, centrifugal forces of the spinning tend to pull the blades away from the rotor and creates a safety hazzard for the people and property in the vicinity of the fan. Moreover, releasing the blades from the Tai assembly requires the use of a pointed implement object, such as a pencil or a screwdriver to push through the opening on the blades to overcome the bias of the compression spring-acutated plate. This still means that the user must be equipped with special tools and work underside the ceiling fan to effect the blade dislodgement. In addition, the opening from the underside of the rotor which allows access of the implement object is unsightly. Furthermore, the Tai assembly is expensive to manufacture and therefore increases the costs of the fan.

It is therefore beneficial to have a ceiling fan which allows the blades to be inserted into the rotor housing with relative ease and yet enables the blades to be locked in position securely. It is also advantageous to be able to dislodge the blades by a single simple step without having the need to use special tools.

SUMMARY OF THE INVENTION

The present invention provides a quick-release blade assembly for a ceiling fan which solves the aforementioned shortcomings. A plurality of blade receiving apertures are evenly spaced apart along the periphery of the fan rotor. Lockable fan blades can be inserted into the lockable blade assembly situated behind the receiving apertures and are concealed inside the rotor housing. Once inserted, the blades are securely locked in operating position. To release a locked blade, the user only needs to push a blade release button on the rotor above the blade receiving aperture and pull the blade away.

It is a principal object of the invention to provide a ceiling fan that allows for easy locking and releasing of fan blades directly into and out of the ceiling fan rotor.

It is another object of the invention to provide a fan blade securely locked inside the rotor such that it will not become loose due to the centrifugal spinning force of the ceiling fan when in operation.

Accordingly, the present invention provides for a ceiling fan lockable quick-release blade assembly which comprises a fan blade having one end for inserting into a blade receiving slot in a fan rotor wherein a notch is provided on the longitudinal side near the insertion end of the blade. A housing defining the blade receiving slot and includes a blade locking member and a blade releasing member; the blade locking member comprises a spring biased locking bolt for locking to the fan blade notch when the fan blade is inserted into the blade receiving slot; the blade releasing member comprises a spring biased releasing means atop the housing and abutting the spring biased locking bolt at a 45° angle whereby upon a user pressing the releasing means the upper projection of the blade locking bat is transversely pushed away thereby causing the lower projection of the locking bat to release the blade from the locking member.

BRIEF DESCRIPTION OF THE DRAWINGS

Advantages and features of the invention will become more apparent with reference to the following description of the presently preferred embodiment thereof in connection with the accompanying drawings, wherein like references have been applied to like elements, in which:

FIG. 1 is a perspective view of a user using one hand to insert a lockable fan blade into an aperture located on the fan rotor of the present invention.

FIG. 2*a* is a perspective view of the fan rotor; FIG. 2*b* is a plan view of a lockable fan blade; & FIG. 2*c* is a side longitudinal view of a lockable fan blade of the present invention.

DETAILED DESCRIPTION OF THE PREFERRED EMBODIMENT

Figure 3:
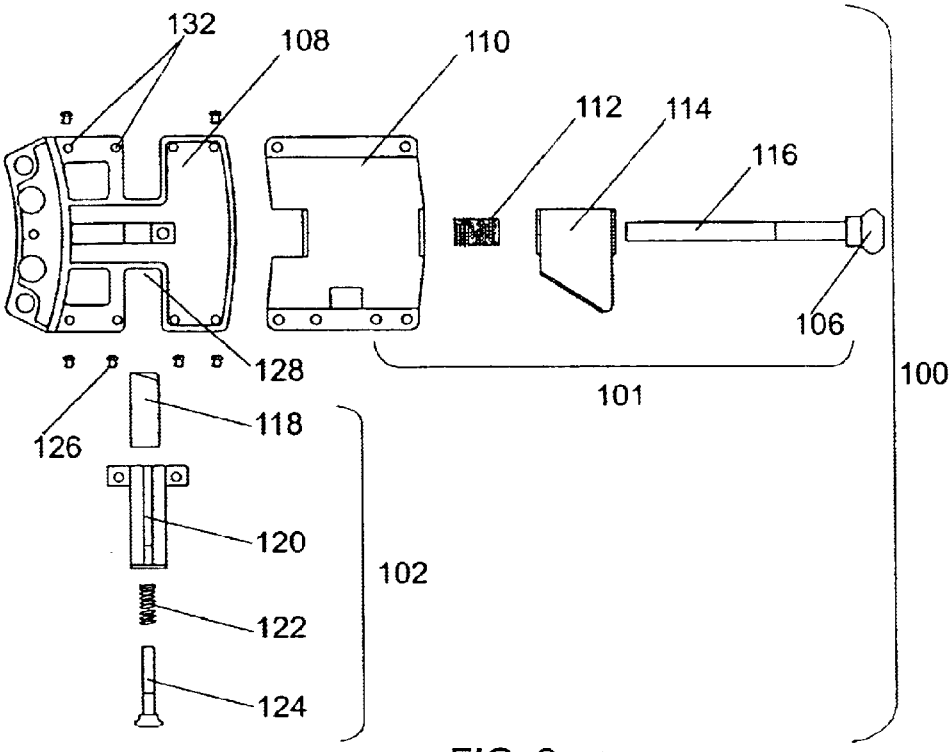
FIG. 3 is a plan view of the parts and components of the lockable blade assembly.

The lockable quick-release blade assembly for ceiling fan of the present invention allows the user to simply insert the fan blades into the blade receiving aperture located in the rotor of the fan. Once inserted, the blades are locked in secure position by the lockable blade assemblies situated behind the aperture inside the rotor. To remove a blade, the user only needs to use one hand to hold on to the blade and uses the other hand to push the blade releasing button to disengage the locked blade.

FIG. 1 illustrates a ceiling fan of the present invention. The figure shows a user inserting the last of the fan blades into the blade receiving aperture located in the fan rotor with one hand. To enhance the aesthetics of the underside view of the ceiling fan, the blade releasing button is situated above the aperture so that the button is completely concealed from the user's view after the blade is inserted into the rotor.

Referring to FIG. 2*a*, it shows a ceiling fan motor housing with rotor 12 in the middle portion of the housing. Blade receiving apertures 104 are spaced apart evenly around the peripheral of rotor 12. In FIG. 2*b*, fan blade 200 is shown to have a rotor-engaging end which is in the direction of the blade facing towards the rotor 12 and a distal end. A blade protrusion member 203 extends from the rotor-engaging end for inserting into the lockable blade assembly 100 which is located inside rotor 12 and behind the blade receiving aperture 104. Notches 202 and 202' are provided on each side of protrusion member 203 for lockably mating to the locking mechanism of the lockable blade assembly 100. FIG. 2*c* shows the corresponding side longitudinal view of fan blade 200 shown in FIG. 2*b*.

The dimension of the blade receiving aperture 104 corresponds with that of the protrusion member 203 on the blades to provide a snug fit.

Figure 4:
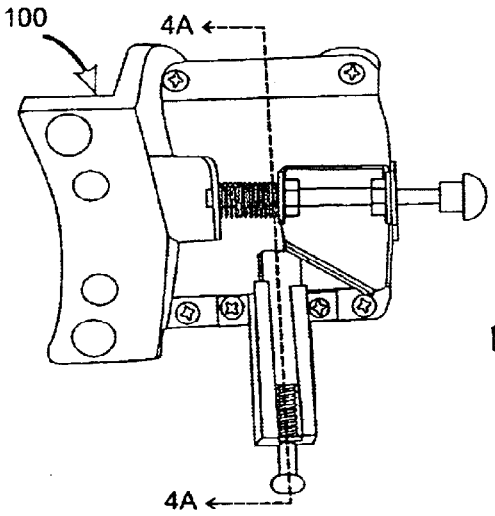
FIG. 4 is an enlarged scale, perspective view of the lockable blade assembly with the parts and components fastened thereto.

FIGS. 3 and 4 illustrate the lockable blade assembly 100 of the present invention. FIG. 3 shows the individual component while FIG. 4 shows the assembly 100 fastened together as one unit. Referring to FIG. 3, assembly 100 comprises a blade holder socket 108 on the bottom and blade holder cover 110 on top. On the top surface of blade holder cover 110 is the blade releasing member 101, which consist of releasing spring 112, slide slice 114 and push pin 116. A blade release button 106 is provided at the end of the push pin 116.

Working cooperatively with the blade releasing member 101 and fastened to the side of blade holder cover 110 by lock screws 126 is the blade locking member 102. Referring to FIG. 3, the blade locking member 102 comprises a fixing pin 124 which biases against lock bolt 118 by locking spring 122 housed inside the bolt tube 120. The other end of lock bolt 118 is urged against a depression 128 formed on the blade holder socket 108.

In order to translate the forward movement of the slide slice 114 (direction BB in FIG. 10) to a side retreating movement of the lock bolt 118 (direction CC in FIG. 10), slide slice 114 is slanted at a 45° angle on the side abutting lock bolt 118, with the narrowest portion of the slice at the locking position (see FIG. 4). As the slide slice 114 moves forward, the 45° slant on the slice 114 forces lock bolt 118 to retreat sideway (see FIG. 11). The corner of lock bolt 118 abutting the slide slice 114 is slightly cut at a corresponding 45° to facilitate the sideway movement of the lock bolt 118 and to assist the cooperation with the slide slice 114 (see FIG. 4).

Figure 4A:
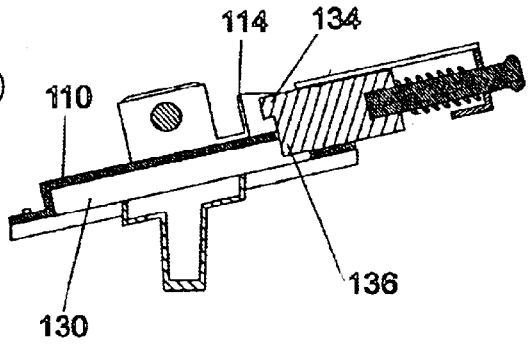
FIG. 4A is a sectional view along lines 4A of FIG. 4.

The blade receiving aperture 104 in the rotor opens into and aligns with the blade receiving slot 130 of lockable blade assembly 100 (see FIGS. 4 and 4A). The dimension of the aperture 104 and the dimension of the blade receiving slot 130 of lockable blade assembly 100 corresponds to one another. In manufacturing, blade receiving slot 130 is formed and defined by the blade holder socket 108 at the bottom and blade holder cover 110 on top and fastened together by screws 126.

Figure 5:
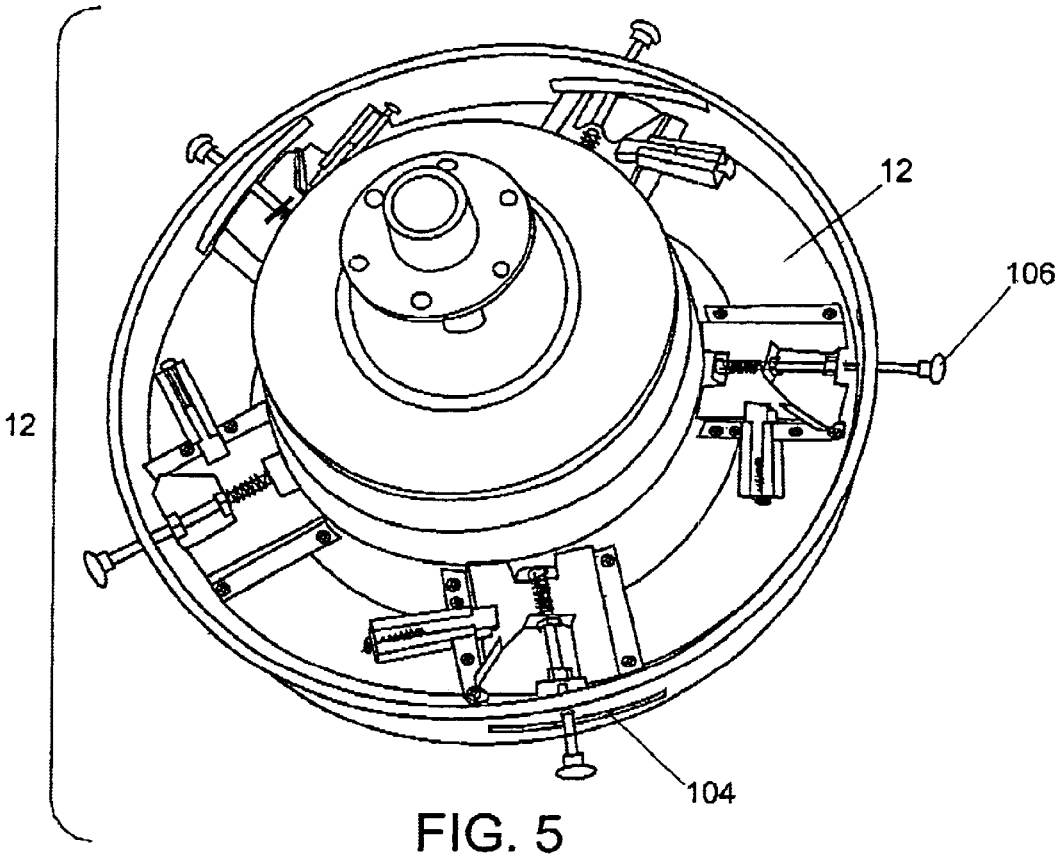
FIG. 5 is a perspective view of the fan rotor having a plurality of lockable blade assembly units fastened thereon to receive the lockable fan blades.

As a unit, the lockable blade assembly 100 is fastened inside the rotor 12 by screws 126 through the various threaded holes 132 provided on the lockable blade assembly 100. FIG. 5 shows rotor 12 with five such assemblies attached thereon.

FIG. 4A is a partial cross-section of the lockable blade assembly 100 along the lines 4A in FIG. 4. It can be seen that the upper projection 134 of the lock bolt 118 is exposed above the upper surface of the blade holder cover 110 and operatively interacts with slide slice 114 of the blade releasing member 101. The lower projection 136 of the lock bolt 118 extends into the side space of the blade receiving slot 130 for engaging the locking notch 202 or 202' of the blade protrusion member 203 when the fan blade 200 is inserted into the rotor aperture 104.

Figure 6:
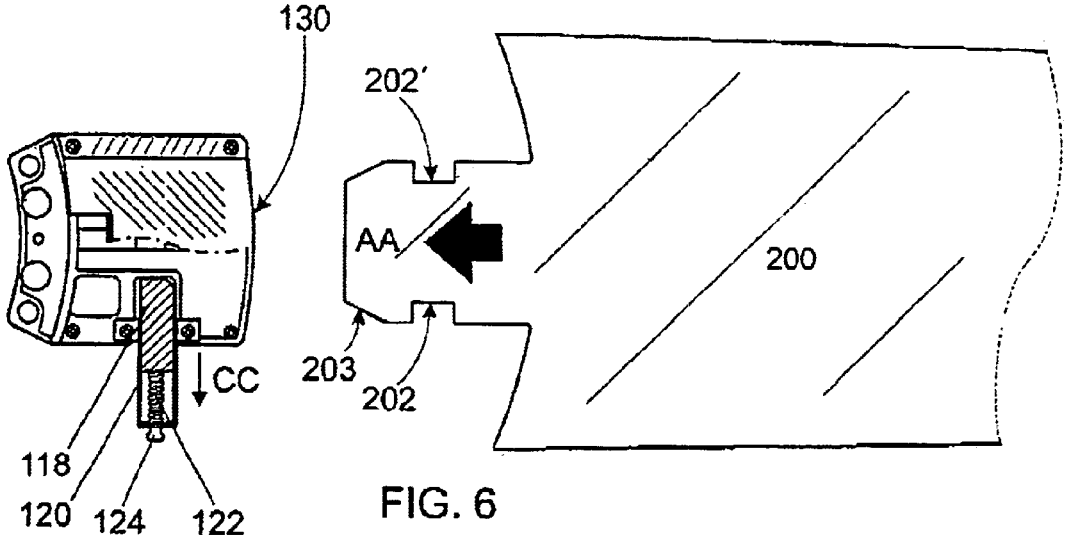
FIG. 6 is a partial plan view of a lockable blade assembly positioned in alignment with the lockable fan blade to be inserted into the assembly.
Figure 7:
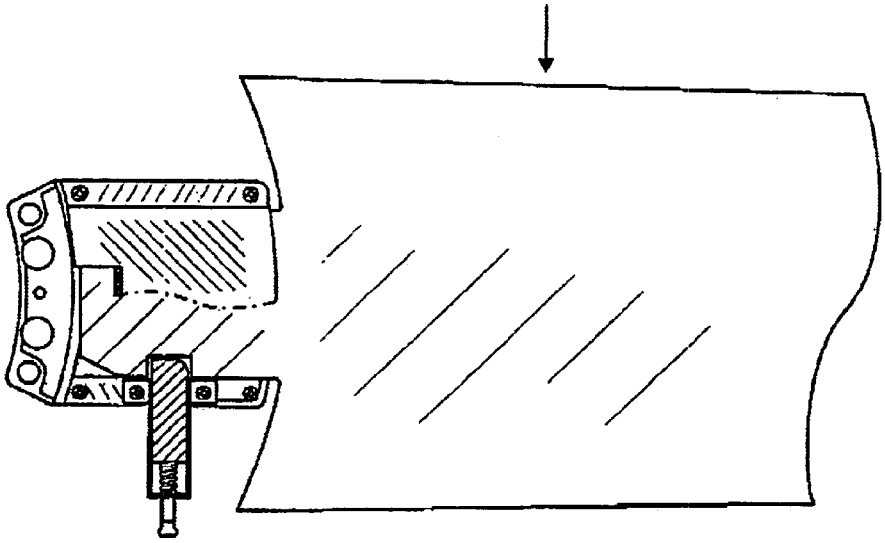
FIG. 7 is a partial plan view of a lockable blade assembly with the fan blade inserted in the assembly in locked position.
Figure 8:
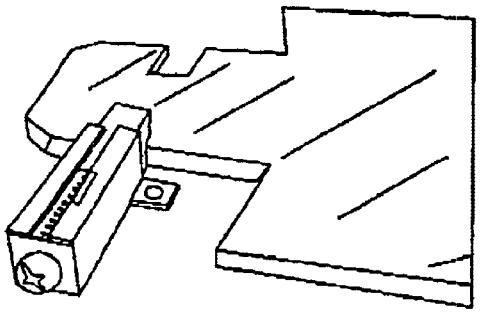
FIG. 8 is a perspective view of the fan blade in a locked position by the blade locking member.

FIGS. 6, 7 and 8 illustrate the locking action of blade 200 using the lockable blade assembly 100 of the present invention. Blade protrusion member 203 of blade 200 is first aligned with the blade receiving aperture 104 (not shown) and blade receiving slot 130. Blade 200 is pushed into slot 130 in the direction AA. The corners of the blade protrusion member 203 are, optionally, rounded to promote ease of entry into the blade receiving slot 130 as well as biasing against lock bolt 118 of the blade locking member 102. Pushed by protrusion member 203, lock bolt 118 is urged to move in an outwardly direction CC inside bolt tube 120 by compressing the locking spring 122. Once the locking notch 202 on protrusion member 203 reaches lock bolt 118, locking spring 122 forces fixing pin 124 and lock bolt 118 to urge into notch 202, thereby locking the fan blade 200 inside the lockable blade assembly 100.

Figure 9:
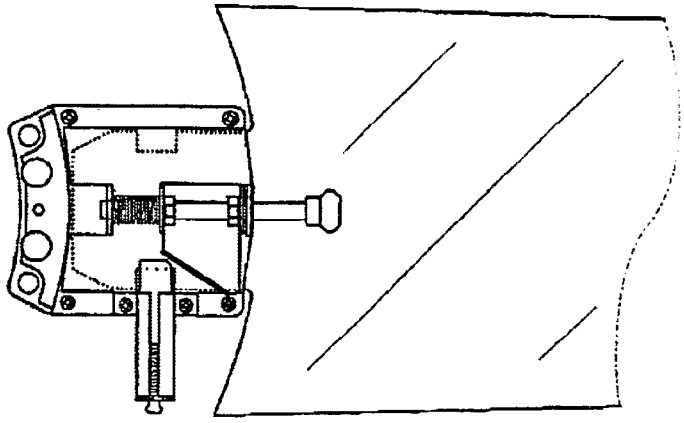
FIG. 9 is another partial plan view of the fan blade in a locked position inside the lockable blade assembly.
Figure 10:
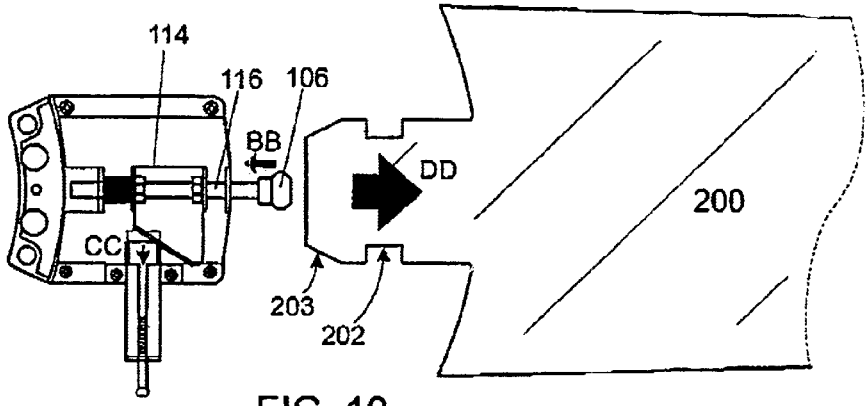
FIG. 10 is a partial plan view of the fan blade being released from the lockable blade assembly.
Figure 11:
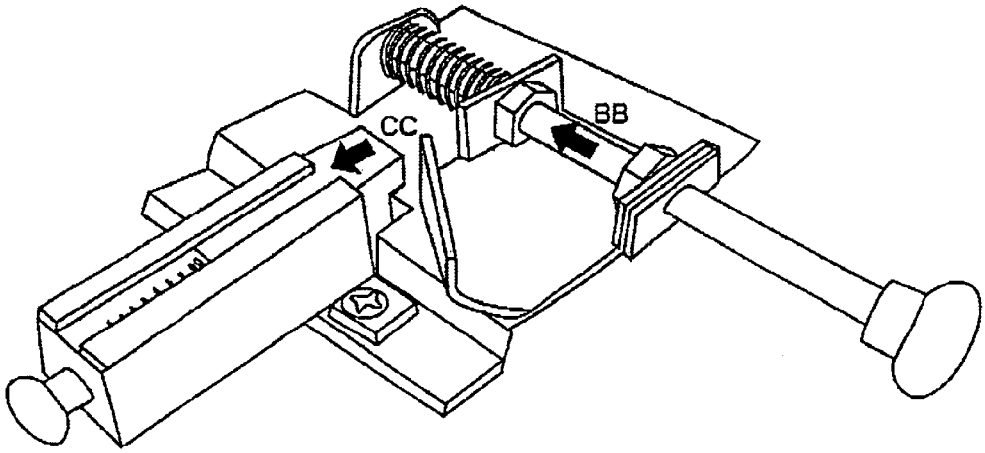
FIG. 11 is a perspective view of the releasing mechanism of the lockable blade assembly.

To release the fan blade 200, the user simply needs to push the blade releasing button 106. Referring to FIGS. 9, 10 and 11, they illustrate co-operation between the blade releasing member 101 and the blade locking member 102 such that when the user pushes the blade-releasing button 106 in the direction BB, the forward movement of the push pin 116 causes the slide slice 114 to likewise move forward, thus forcing the lock bolt 118 to be compressedly retreated in the direction CC, thereby disengaging the lock bolt 118 from locking notch 202 on the side of the blade protrusion member 203 and allowing blade 200 to be released and pulled away from the assembly 100 in the direction DD.

Once fan blade 200 is released from the lockable blade assembly 100, both the slide slice 114 and lock bolt 118 will return to their resting locking position, as shown in FIG. 4.

Optionally, locking notch 202' is provided on the other side of blade protrusion member 203 so that users may insert the reverse side of the fan blade into rotor 12. While the preferred embodiment of the lockable quick-release blade assembly of the present invention is made of steel, other suitable materials can be used. Likewise, although screws are generally used to assemble the blade releasing member 101 and blade locking member 102 and to attach the completed assembly onto rotor 12, other suitable fastening means, such as welding can be employed instead.

Hence, although the present invention has been described with reference to a preferred embodiment, it will be appreciated by those skilled in the art that various modifications, alternations, variations, and substitutions of parts and components may be made without departing from the spirit and scope of the invention. Therefore, the present application is intended to cover such modifications, alternations, variations, and substitutions of parts and components.

What is claimed is:

1. A ceiling fan lockable quick-release blade assembly, comprising:

a fan blade having one end for inserting into a blade receiving slot in a fan rotor, said blade inserting end is provided with a notch on the longitudinal side of the blade near said blade end;

a housing defining said blade receiving slot, said housing including a blade locking member and a blade releasing member;

said blade locking member comprises a spring biased locking bolt for locking into said fan blade notch when said blade is inserted into said blade receiving slot in said housing; and said blade releasing member comprises a spring biased releasing means atop said housing and abutting said spring biased locking bolt at a 45° angle, wherein upon a user pressing said releasing means actuates an upper projection of said blade locking bolt to be transversely pushed away thereby causing a lower projection of the locking bolt to release said blade from said locking member.

2. A ceiling fan lockable quick-release blade assembly of claim 1, wherein said assembly is fastened inside the fan rotor with said blade receiving slot situated on the outside periphery of said rotor casing.

3. A ceiling fan lockable quick-release blade assembly of claim 2, wherein a plurality of said assemblies are disposed in equally spaced relation to one another inside said fan rotor.

4. A ceiling fan lockable quick-release blade assembly of claim 1, wherein said spring biased releasing means comprises a spring compressed push pin operatively attached to a slidable means whereby said spring biased locking bolt is transversely pushed away to release the locked fan blade when the user presses said spring compressed push pin.

5. A ceiling fan lockable quick-release blade assembly of claim 4, wherein said slidable means is a slide slice.

6. A ceiling fan lockable quick-release blade assembly of claim 4, wherein said push pin is connectively attached to a blade release button located outside the fan rotor.

7. A ceiling fan lockable quick-release blade assembly of claim 1, wherein two notches are provided on each side of said fan blade insertion end.

8. A ceiling fan lockable quick-release blade assembly of claim 1, wherein the corners of said blade inserting end are slightly rounded.

9. A ceiling fan lockable quick-release blade assembly of claim 1, wherein the comer of said spring biased locking bolt abutting said blade releasing means is cut at a 45° angle.

* * * * *